United States Patent [19]

Forster

[11] Patent Number: 4,586,272

[45] Date of Patent: May 6, 1986

[54] GAITER FOR GRAVITY RELIEVING APPARATUS

[76] Inventor: Helmut Forster, Greppenstrasse 77, 8031 Alling, Fed. Rep. of Germany

[21] Appl. No.: 613,964

[22] Filed: May 24, 1984

[30] Foreign Application Priority Data

May 31, 1983 [DE] Fed. Rep. of Germany ... 8315953[U]

[51] Int. Cl.[4] ..... A41D 17/00

[52] U.S. Cl. ..... 36/2 R; 128/75; 272/144; 36/2 A

[58] Field of Search ..... 36/2 R, 2 A, 2 B, 1.5; 2/61; 128/75, 84 R; 272/145, 144

[56] References Cited

U.S. PATENT DOCUMENTS

| | | | |
|---|---|---|---|
| 1,132,835 | 3/1915 | Dehler | 36/2 R |
| 1,442,392 | 1/1923 | Gantenbein | 36/1.5 |
| 1,708,144 | 4/1929 | Martin | 36/2 R |
| 2,511,182 | 6/1950 | Spencer | 128/84 R |
| 2,723,663 | 11/1955 | Davis | 128/75 |
| 2,902,779 | 9/1959 | Cook | 36/2 R |
| 2,945,308 | 7/1960 | Pence | 36/2 R |
| 3,380,447 | 4/1968 | Martin | 128/75 |
| 3,621,489 | 11/1971 | Keller | 36/2 R |

*Primary Examiner*—Werner H. Schroeder
*Assistant Examiner*—Mary A. Ellis
*Attorney, Agent, or Firm*—Wolf, Greenfield & Sacks

[57] ABSTRACT

Gaiter for gravity relieving apparatus comprising a casing arrangement for encircling the lower leg at least in the region of the ankle and having two padded casing parts flexibly connected together by means of lacing means, which casing arrangement is constructed for opening for donning and removal and is provided with means for suspending the gaiter aloft.

15 Claims, 7 Drawing Figures

GAITER FOR GRAVITY RELIEVING APPARATUS

Figure 1:
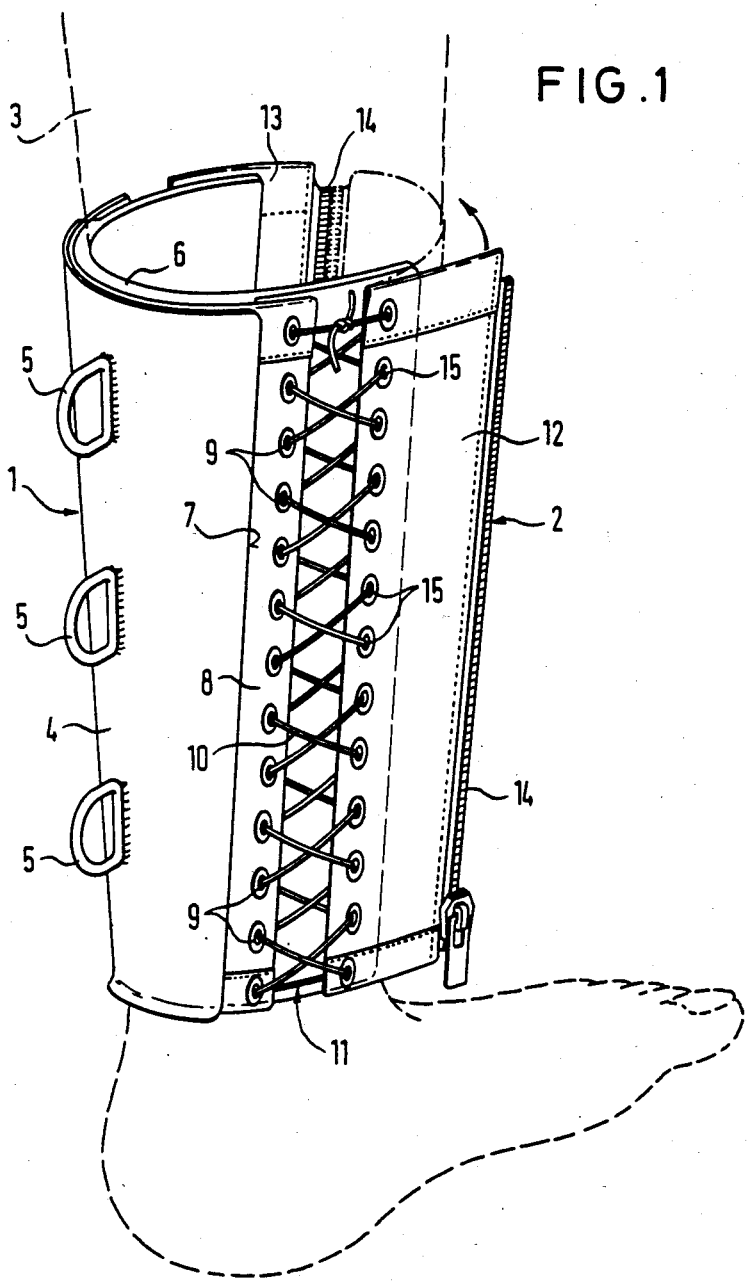

The present invention relates to a gaiter for gravity relieving apparatus, having a casing arrangement encircling the lower leg at least in the region of the ankle and consisting substantially of two padded casing parts, the casing arrangement being openable for donning and removal and being provided with a suspension arrangement.

In recent times, for relief of the intervertebral discs and for stretching of the lumbar vertebrae and the hip joints, so called gravity relieving apparatus has been employed to an increasing extent. This consists of a hanging device which is constructed either in the form of a simple stretching bar-type construction (cf. for example FIG. 1 of U.S. Pat. No. 3,380,447) or as more or less expensive tilting table constructions (cf. for example the brouchure "Gravity Guiding System"). Essential component parts are so-called ankle devices or gaiters (cf. for example FIGS. 2 to 5 of U.S. Pat. No. 3,380,447) which encircle the lower leg in the region of the ankle and are provided with suspension devices in the form of hooks by which they can be coupled to the hanging device.

With gaiters of this type, the casing parts or jaw members are connected together in the region of their one lateral edge by means of a hinge joint arrangement and in the region of their other lateral edge by means of a buckle clasp. This has the advantage that donning and removal can be carried out quickly and without problems.

It is however disadvantageous that on the basis of this construction the casing parts are in the closed condition fixedly coupled together so that adaption to various sizes of lower leg and shapes of lower leg is possible only by change of the thickness of the padding. In practice, this change of the thickness of the padding is carried out by insertion of foam material pieces or strips whereby however only very imperfect adaption can be achieved. Also, this method is very cumbersome since the foam material strips or pieces can slip or become lost.

Because of the completely stiff construction existing in the closed condition with such a gaiter moreover uniform distribution of the pressure in the hanging process is not possible, so that regions of high pressure and thereby pressure points on the leg cannot be prevented. In practice it is for this reason sought to alleviate these uncomfortable consequences by the insertion of further padding. The result is that when donning such known gaiters as a rule a plurality of foam material pieces must be manipulated and arranged in particular positions whereby the above-described advatnage in respect of rapid donning is at least partially nullified.

The object of the present invention is to develop a gaiter of the above-described type whilst retaining its advantages in such manner that precise adaption to the respective size of lower leg and form of lower leg is possible.

This object is solved according to the invention in that the two casing parts are flexibly mutually connected by means of lacing.

The invention is based on the thought of dissolving the till now usual stiff connection between the two casing parts of the gaiter and replacing this by a flexible connection in the form of lacing. This has the advantage that besides simple adaption possibilities to practically any form and size of lower leg, automatic pressure equlization takes place in the hanging process since the casing parts can mutually displace and/or pivot according to the forces being applied to the same.

A construction according to the invention has furthermore the advantage that following a first basic adaption at a later time a correction or as the case may be readjustment is easily possible. Loose padding strips or the like which can slip or become lost are not necessary in this connection. It is furthermore of advantage that gaiters according to the invention are lighter than known gaiter constructions and have a smaller space requirement. Regions of high pressure which cannot be prevented with the known gaiters because of the stiff connection between the casing parts, practically cannot occur with gaiters constructed according to the invention.

Basically, the lacing can be constructed in any desired manner so long as it is ensured that the casing parts are mutually displaceable and/or pivotable within certain limits. It is however an advantage to split the lacing into two lacing courses and to arrange in each case one lacing course in the region of the neighboring side edges of the two casing parts. With gaiters of this type, one casing part is thereby located over the shin bone and the other casing part on the rear side of the lower leg in the region of the calf, the lacing courses of the lacing running in each case laterally on the lower leg and the two casing parts being flexibly connected together.

A particularly expedient construction results if in such an arrangement the neighboring lateral edges of the two casing parts are arranged at a mutual spacing and the lacing courses bridge over this spacing. Experiments have shown that it is sufficient if the casing parts in such an arrangement encircle the lower leg over approximately a quarter to a third of its periphery.

Basically, the lacing courses can be arranged and executed in the most varied manners between the casing parts. For the formation of a particularly simple construction it can be sufficient if in the region of the lateral edges of the casing parts openings are provided for the return of the lace of the lacing course. There can however also be provided in the region of the lateral edges hooks, eyes or rollers for the return guidance of the lace of the lacing course. It is only necessary that these guide elements are constructed in such manner that the smallest possible friction results.

Good force distribution in the hanging process is achieved if the casing parts are arranged to extend longitudinally and parallel to the axis of the leg. In this connection it has proved to be expedient to select the length of the casing parts so that they correspond to at least half of the length of the lower leg.

Basically, the casing parts can have any desired form. Thus, the lateral edges of the casing parts can extend in each case parallel to one another. Particularly expedient construction results however if the spacing of the lateral edges of at least one casing part reduces in the direction of the heel, i.e. is adapted to the reducing periphery of the lower leg from the calf to the heel.

Basically, the opening of a gaiter of the type according to the invention for donning and removal can be undertaken in any desired manner. A particularly expedient possibility for opening is however achieved in that one of the two casing parts consists of two sections each having a lateral edge which are mutually connected via a quick release. With such a construction one of the casing parts is constructed to be so to speak bipartite, the two parts being able to be coupled together via a quick release whereby a particularly simple and quick donning and removal is enabled.

In a particularly advantageous embodiment of a gaiter according to the invention the two sections are manufactured of a flexible material and the quick release is formed as a zip fastener. By the term "flexible material" in the present case strong material or leather strips or flexible synthetic material strips or the like are to be understood.

As a suspension arrangement, with gaiters of the type according to the invention hooks can be provided in known manner. For special hanging devices it can however be expedient to provide suspension arrangements in the form of a plurality of aligned rings.

Figure 2:
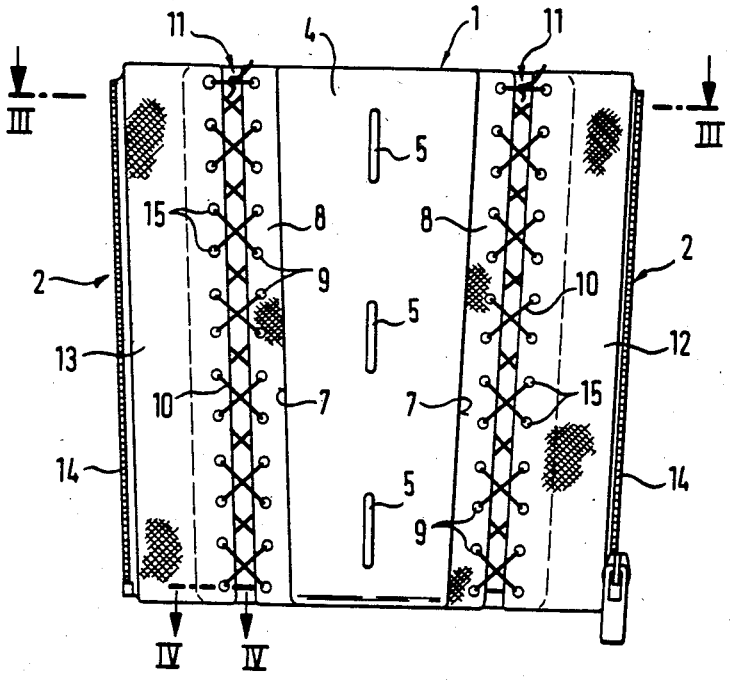
Figure 3:
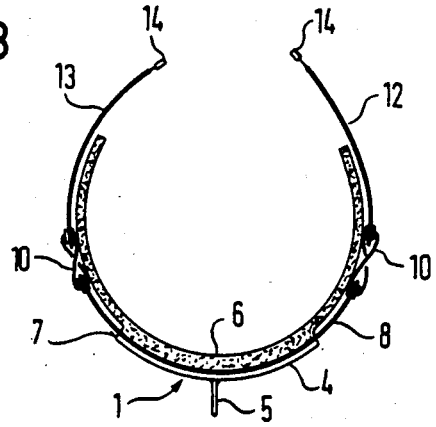
Figure 4:
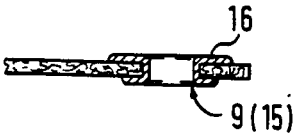
Figure 5:
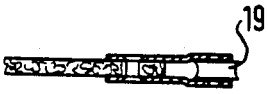
Figure 6:
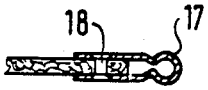
Figure 7:
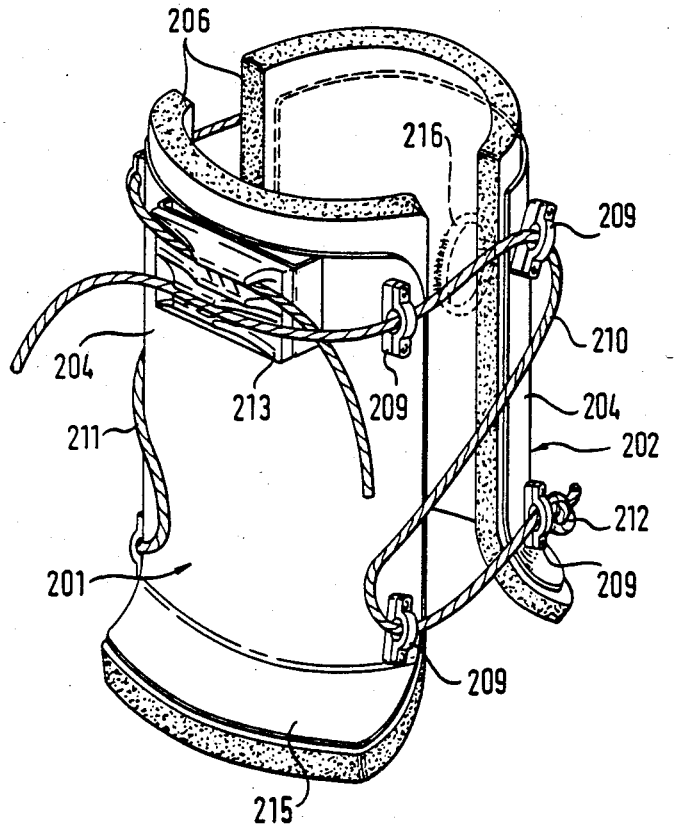

In the following for further explanation and for better understanding exemplary embodiments of the invention are described in more detail with reference to the attached drawings, in which:

FIG. 1 shows schematically in perspective view an exemplary embodiment of a gaiter according to the invention, FIG. 2 shows the gaiter according to FIG. 1 in an open condition, FIG. 3 shows a section along the plane III—III of FIG. 2, FIG. 4 shows a section along the plane IV—IV of FIG. 2, FIGS. 5 and 6 show two further exemplary embodiments in a view according to FIG. 4, and FIG. 7 shows a modified embodiment.

The gaiter represented in FIGS. 1 to 3 consists substantially of two padded casing parts 1 and 2 which encircle the lower leg 3 in the region of the ankle.

In the present exemplary embodiment the casing part 1 consists of a channel-like arcuate metl plate strip 4 which is equipped on its outer side with three aligned rings 5. The metal plate strip 4 is provided on its inner side with an outer padding 6 which extends beyond its lateral edges 7 such as may be seen particularly well from FIG. 3. The casing part 1 is furthermore provided in the region of its lateral edge 7 with a material strip 8 in which a pluality of openings 9 are provided above one another for the threading of a lace 10 of lacing 11.

The casing part 2 consists in the present exemplary embodiment of two sections 12 and 13 which can be manufactured from flexible material, for example a cloth, leather or the like. The sections 12 and 13 are mutually connected via a quick release which in the present case is constructed in the form of a zip fastener 14. The sections 12 and 13 are provided in the region of their edges adjacent the lateral edges of the casing part 1 with openings 15 which correspond to the openings 9 of casing part 1 and serve likewise for the threading of the lace 10 of lacing 11.

As may be seen from FIG. 4, the openings 9 or 15 are each provided with a grommet 16 which can be manufactured for example of synthetic material metal. These grommets have a relatively flat upper surface and rounded edges and corners so that the friction during threading of the lace 10 is relatively small.

Instead of grommets 16 also eyes 17 can be provided for the threading of the lace 10 of lacing 11 such as is represented for example in FIG. 6. These eyes consist substantially from a U-shaped clip which is secured by means of a rivet 18 in the lateral edges of the casing parts.

In order to reduce the friction further during lacing of the lace 10 of lacing 11, instead of the grommets or eyes small rollers 19 can be provided such as are represented for example in FIG. 5. By such rollers 19 the friction in the threading process of the lace is limited to a minimum and thereby the process of adapting the casing parts 1 and 2 to the lower leg 3 is considerably simplified.

Gaiters constructed according to the invention are delivered with a relatively loose lacing. For adaption of the gaiters it is only necessary to lay these in the ankle region around the lower leg 3 and to close the zip fastener 14. Following this, the two lace courses 11 of the lacing need only be adapted to the corresponding size and form of the lower leg. For this purpose, contrary to the known constructions, no form of extra inserted foam material strips or the like padding are required.

After a few suspension trials it can be necessary to correct the fitting of the gaiter. This is also possible without difficulty since for this purpose likewise only the lacing 11 must be readjusted in known manner. When the final setting has been reached, further manipulation of the lacing is no longer necessary. For donning and removal of the gaiters it is then only necessary to open or close the zip fastener 14.

In the present exemplary embodiment for coupling on of a special construction of hanging device three rings 5 are arranged above one another on the rear side of the casing part 1. Instead of the rings 5 it is also of course possible to provide hooks or the like suspension devices. For use with conventional suspension devices, the gaiters can also be arranged in such manner that the hooks or rings 5 come to lie on the shin side of the lower leg 3.

FIG. 7 shows a modified embodiment of gaiter which has the advantage of quick donning and removal and is relatively compact.

The gaiter comprises two padded casing parts 201 and 202 each of which consists of a channel-like arcuate metal strip 204 provided on is inner side with a padding layer 206. Each casing part is provided on each of its lateral edges with two threading members 209 for receiving in each case a respective lace member 210 or 211. Each lace member has at one end a knot 212 and is secured at its other end after passing in a zigzag formation through the threading members 209 in a clamp member 213. This clamp member is preferably, as illustrated, of the toothed grip type. Preferably, as illustrated, the grip comprises two toothed channels for receiving respective ends of the two lace members 210 and 211.

At its lower peripheral edge, each casing member 201 or 202 has an outwardly flared portion 215. This increases the comfort for the wearer.

The clamp member 213 is mounted on casing member 201. On the other casing member 202 a ring 216 is provided for attachment to the cable line of a suspension device.

The outwardly flared lower edge 215 can also be provided in the earlier described embodiment of gaiter.

As compared with this earlier embodiment, the embodiment of FIG. 7 is relatively compact and quick in donning and removal.

I claim:

1. Gaiter for gravity relieving apparatus comprising:

a casing arrangement for encircling the lower leg at least in the region of the ankle and means for suspending the gaiter aloft, said casing arrangement comprising: two padded casing parts; lacing means for flexibly connecting said parts together; and quick-release means for opening said casing arrangement for donning and removal.

2. Gaiter according to claim 1 wherein the lacing means comprises two lacing courses, each being arranged in the region of mutually adjacent lateral edges of the two casing parts.

3. Gaiter according to claim 2 wherein the mutually adjacent lateral edges of the two casing parts are arranged at a spacing from one another and the lacing courses bridge over this spacing.

4. Gaiter according to claim 3 wherein openings are provided in the region of the lateral edges for threading of a lace of the lacing means.

5. Gaiter according to claim 3 wherein hooks are provided in the region of the lateral edges for threading of a lace of the lacing means.

6. Gaiter according to claim 3 wherein eyes are provided in the region of the lateral edges for threading of a lace of the lacing means.

7. Gaiter according to claim 3 wherein rollers are provided in the region of the lateral edges for threading of a lace of the lacing means.

8. Gaiter according to claim 1 wherein the two casing parts are elongate.

9. Gaiter according to claim 8 wherein the length of the casing parts corresponds at least to half of the length of the lower leg.

10. Gaiter according to claim 1 wherein the casing parts are wide enough to encircle the lower leg over approximately a quarter to one third of the periphery thereof.

11. Gaiter according to claim 8 wherein latral edges of one casing part extend parallel to one another.

12. Gaiter according to claim 8 wherein the width of at least one casing part tapers in the direction of the heel.

13. Gaiter according to claim 1 wherein one of the two casing parts consits of two sections having respective lateral edges which are connected together via said quick-release means.

14. Gaiter according to claim 13 wherein the two sections consist of a flexible material and the quick release is a zip fastener.

15. Gaiter according to claim 1 wherein one of the two casing parts is provided with suspension means in the form of a plurality of rings arranged above one another.

* * * * *